US006053177A

United States Patent [19]

Sofer

[11] Patent Number: 6,053,177

[45] Date of Patent: Apr. 25, 2000

[54] CARTRIDGE FOR HAIR DYE DISPENSER

[75] Inventor: Menachem Sofer, Ramle, Israel

[73] Assignee: Montes Product Development Ltd., Ramat Hasharon, Israel

[21] Appl. No.: 09/253,775

[22] Filed: Feb. 22, 1999

[51] Int. Cl.[7] ..... A45D 24/26

[52] U.S. Cl. ..... 132/112; 132/116; 132/108; 401/176; 401/179

[58] Field of Search ..... 132/112, 113, 132/114, 115, 116, 108, 212, 208, 270, 272; 401/171, 176, 177, 179, 180, 181, 287, 290; 222/137, 145.5, 145.6, 326, 327

[56] References Cited

U.S. PATENT DOCUMENTS

| | | | |
|---|---|---|---|
| 1,607,674 | 11/1926 | Ives | 132/114 |
| 3,952,920 | 4/1976 | Bergman | 222/137 |
| 4,934,388 | 6/1990 | Gibbs | 132/112 |
| 5,059,050 | 10/1991 | Guglielmo | 132/112 |
| 5,060,679 | 10/1991 | Christopher et al. | 132/114 |
| 5,333,627 | 8/1994 | Mehringer et al. | 132/112 |

*Primary Examiner*—Gene Mancene
*Assistant Examiner*—Pedro Philogene
*Attorney, Agent, or Firm*—Mark M. Friedman

[57] ABSTRACT

A cartridge for use in a hair dye dispenser includes a dispensing container for containing and dispensing the hair dye, the dispensing container having a base and at least one side wall sealingly attached to or integrally formed with the base so as to define an internal volume of the dispensing container. The base has a lower surface that is formed with a number of projecting tines and at least one dispensing aperture. A piston is configured to fit closely in sliding abutment with the at least one side wall so as to be sealingly slidable towards the base. The dispensing container and the piston are formed from polymer material, the piston being pressure-fitted within the dispensing container so as to define an initial position of the piston.

14 Claims, 8 Drawing Sheets

CARTRIDGE FOR HAIR DYE DISPENSER

FIELD AND BACKGROUND OF THE INVENTION

The present invention relates to hair dye dispensers and, in particular, it concerns a cartridge for use with such a dispenser and a method of using such a cartridge.

It is known to provide a hair dye dispenser for dispensing dye into the hair of a user. Of particular relevance to the present invention is a hair dye dispenser disclosed in PCT Patent Publication No. WO 98/51183 which is hereby incorporated by reference as if set out in its entirety herein. The dispenser in question will now be described with reference to FIG. 1 which corresponds to FIG. 2 of the aforementioned application. For the sake of clarity, the original numerals will be identified within parentheses. Thus, WO 98/51183 provides a hair dye dispenser (1) for dispensing a fluid hair dye. Dispenser (1) includes a dispensing container (3), formed with a base and a side wall, for containing and dispensing the hair dye. The base is provided with a number of projecting tines (11) and dispensing apertures (15). A piston (17) slides in abutment with the wall of the dispensing container. The dispenser (1) also includes a housing for receiving the dispensing container (3) and an actuation mechanism for displacing the piston (17) towards the base so as to dispense the hair dye through the dispensing apertures (15).

While providing a highly convenient and effective method for applying dye to the hair, the aforementioned device has been found to suffer from certain limitations. Specifically, the device relies upon the user to fill the dispensing container with pre-mixed hair dye and then to position the piston within the container ready for use. This reliance on the user to correctly position and align the piston within the dispensing container has been found to be problematic. Even a relatively small misalignment of the piston may present a risk of seepage or squirting of the dye which could damage clothing or furnishings and which is generally inconvenient. A more extreme misalignment could possibly lead to breakage of the piston or dispensing container.

There is therefore a need for pre-aligned cartridge for use with a hair dye dispenser in which the various components are located in a correct interrelation for use without reliance on positioning by the user. It would also be highly advantageous to provide a corresponding method for preparing such a cartridge for use.

SUMMARY OF THE INVENTION

The present invention is a cartridge for use with a hair dye dispenser and a method of using such a cartridge.

According to the teachings of the present invention there is provided, a cartridge for use in a hair dye dispenser, the cartridge comprising: (a) a dispensing container for containing and dispensing the hair dye, the dispensing container having a base and at least one side wall sealingly attached to or integrally formed with the base so as to define an internal volume of the dispensing container, the base having a lower surface which is formed with a plurality of projecting tines, at least one dispensing aperture being formed through the base; and (b) a piston configured to fit closely in sliding abutment with the at least one side wall so as to be sealingly slidable towards the base, wherein, the at least one dispensing aperture is implemented as dispensing channel along one of the projecting tines.

In this case, the projecting tine has an axis and a tip, the dispensing channel including: (a) a central channel extending within the tine parallel to the axis; and (b) a dispensing slot formed through the tine adjacent to the tip so as to intersect with the central channel, the dispensing slot having a dispensing area, wherein the central channel has a given effective cross-sectional area adjacent to the dispensing slot, the effective cross-sectional area being at least about equal to the dispensing area.

There is also provided according to the teachings of the present invention, a cartridge for use in a hair dye dispenser, the cartridge comprising: (a) a dispensing container for containing and dispensing the hair dye, the dispensing container having a base and at least one side wall sealingly attached to or integrally formed with the base so as to define an internal volume of the dispensing container, the base having a lower surface which is formed with a plurality of projecting tines, at least one dispensing aperture being formed through the base; and (b) a piston configured to fit closely in sliding abutment with the at least one side wall so as to be sealingly slidable towards the base, wherein the piston features an aperture provided with a complementary removable sealing element to allow introduction of at least one dye component into the cartridge.

There is also provided according to the teachings of the present invention, a cartridge for use in a hair dye dispenser, the cartridge comprising: (a) a dispensing container for containing and dispensing the hair dye, the dispensing container having a base and at least one side wall sealingly attached to or integrally formed with the base so as to define an internal volume of the dispensing container, the base having a lower surface which is formed with a plurality of projecting tines, at least one dispensing aperture being formed through the base; and (b) a piston configured to fit closely in sliding abutment with the at least one side wall so as to be sealingly slidable towards the base, wherein the base features an aperture provided with a complementary removable sealing element to allow introduction of at least one dye component into the cartridge.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
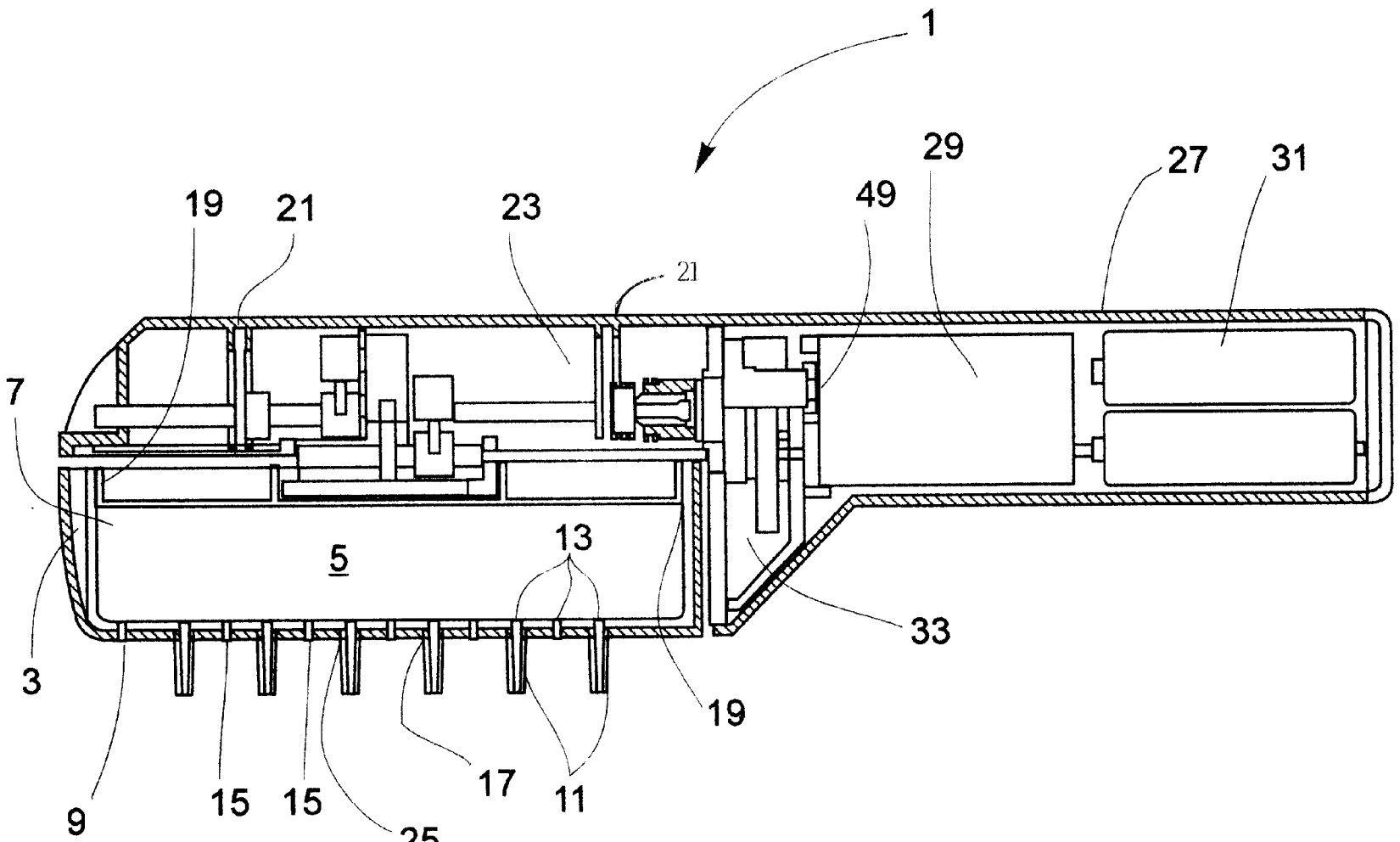
Fig. 1 (PRIOR ART)
FIG. 1 is a side cross-sectional view of a conventional hair dye dispenser corresponding to FIG. 2 of PCT Patent Publication No. WO98/51183.

The present invention is a cartridge for use with a hair dye dispenser and a method of using such a cartridge.

The principles and operation of hair dye cartridges according to the present invention may be better understood with reference to the drawings and the accompanying description.

Referring now to the drawings, FIGS. 2–5 show four implementations of a cartridge, constructed and operative according to the teachings of the present invention, for use with a hair dye dispenser. In each case, the function of the cartridge when placed within a hair dye dispenser is essentially similar to that of the dispensing container and piston combination described in the aforementioned PCT Patent Publication No. WO98/51183, with certain exceptions that will be described below. Accordingly, all of the cartridges have a basic structure including a dispensing container 10 and a piston 12. In its most general form, dispensing container 10 is described as having a base 14 and at least one side wall 16 sealingly attached to or integrally formed with base 14 so as to define an internal volume of the dispensing container. Base 14 has a lower surface formed with a plurality of projecting tines 18. At least one dispensing aperture 20 is formed through base 14, preferably along at least part the length of one or more of the tines. Piston 12 is configured to fit closely in sliding abutment with the at least one side wall so as to be sealingly slidable towards base 14.

The particular features in which the cartridges of the present invention differ from the corresponding components of the aforementioned application relate primarily to the manner in which the cartridge is prepared for use. Specifically, it is a particular feature of most preferred embodiments of the present invention that piston 12 is pre-aligned in its proper initial position within dispensing container 10 prior to a filling procedure to be performed by the user. This avoids reliance upon the user to ensure accurate alignment of the piston, thereby circumventing the problems of soiling and mechanical failure discussed above.

Before turning to the structural features of the cartridges of the present invention in detail, it should be appreciated that the present invention is useful in a wide range of applications in which a dispenser is used to apply fluid to the hair or sclap for coloring, tinting, bleaching or any other treatment. By way of example, the invention will be described in the context of a dispenser for applying hair dye. However, references to "dye" and "hair dye dispenser" are not to be construed to limit the claimed structures in any way.

It should noted that the term "fluid" is used herein in the description and claims to refer to any composition or mixture which flows such that it can be dispensed through dispensing apertures 20 under applied pressure. Examples of fluids according to this definition include, but are not limited to, liquids, suspensions, gels, creams and pastes of a wide range of thicknesses.

It will be clear that the present invention relates primarily, although not necessarily exclusively, to single-use cartridges which are either disposed of or recycled after use.

Turning now to the structural features of the cartridges of the present invention, as mentioned before, piston 12 is pre-aligned in an initial position within dispensing container 10. In other words, the initial position and alignment of the piston is set, typically during manufacture of the cartridge, in a manner which will tend to ensure correct alignment until the cartridge is inserted into a dispenser for use. To this end, the piston must be held firmly enough in relation to the dispensing container to prevent displacement by gentle finger contact or small inadvertent knocks to the cartridge. On the other hand, the piston should not offer particularly large resistance to an actuator mechanism of a dispenser while in use. A particularly preferred set of embodiments of the present invention employs pressure-fitting of the components, used alone or together with other retaining features, to hold the piston in position.

Specifically, dispensing container 10 and piston 12 are both preferably formed from polymer materials. Examples of appropriate materials include, but are not limited to, polypropylene and various plastics. Piston 12 is then pressure-fitted within dispensing container 10 so that it is held in its initial position sufficiently tightly to withstand light finger contact or inadvertent knocks. In this context, the phrase "pressure-fitting" is used to refer to the technique known in the manufacture of plastic articles in which an element is inserted under pressure into a slightly undersized opening in a second element. This causes slight elastic flexing of piston 12 and/or local outward elastic deformation of wall 16, thereby generating considerable contact forces and ensuring the required degree of sealing between piston 12 and wall 16. The flexed and/or locally deformed structure provides retentive forces that help to prevent the two elements from slipping out of their predefined positions. At the same time, the dimensions and material of the piston and wall are chosen such that they do not generate excessive resistance to the actuating mechanism of a dispenser. Typically, the force required to displace the piston is chosen to be between about 1 and about 5 kg-force.

It should be noted that the retaining effects of pressure-fitting may optionally be enhanced by one or more additional retaining means. Examples include, but are not limited to, provision of small inward projections or ledges in wall 16 to define the initial position, and point welding to produce a frangible connection between piston 12 and wall 16.

Figure 3:
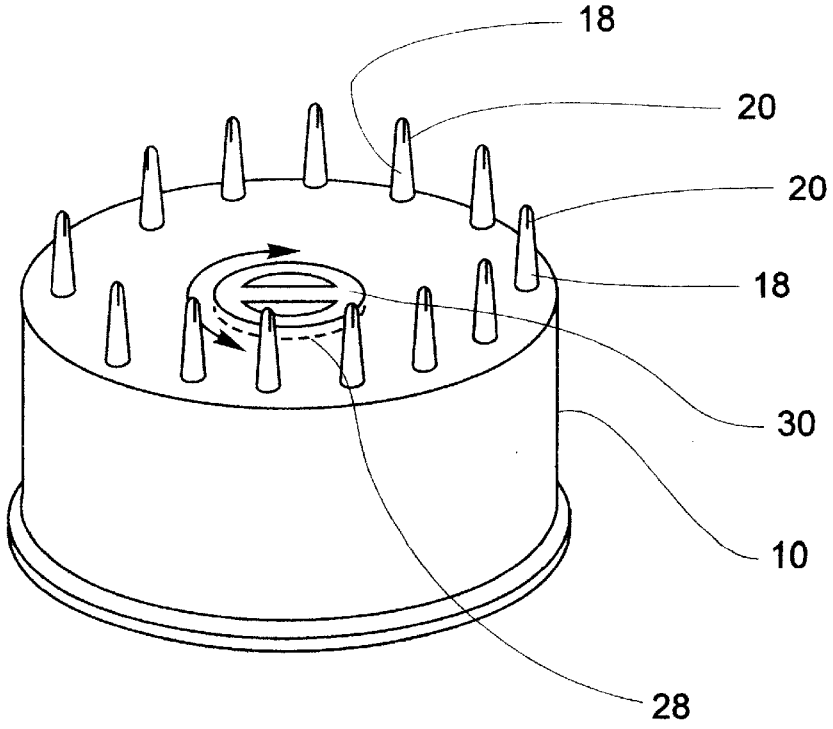
FIG. 3 is a schematic isometric view of a second implementation of a cartridge for use in a hair dye dispenser, constructed and operative according to the teachings of the present invention.
Figure 4:
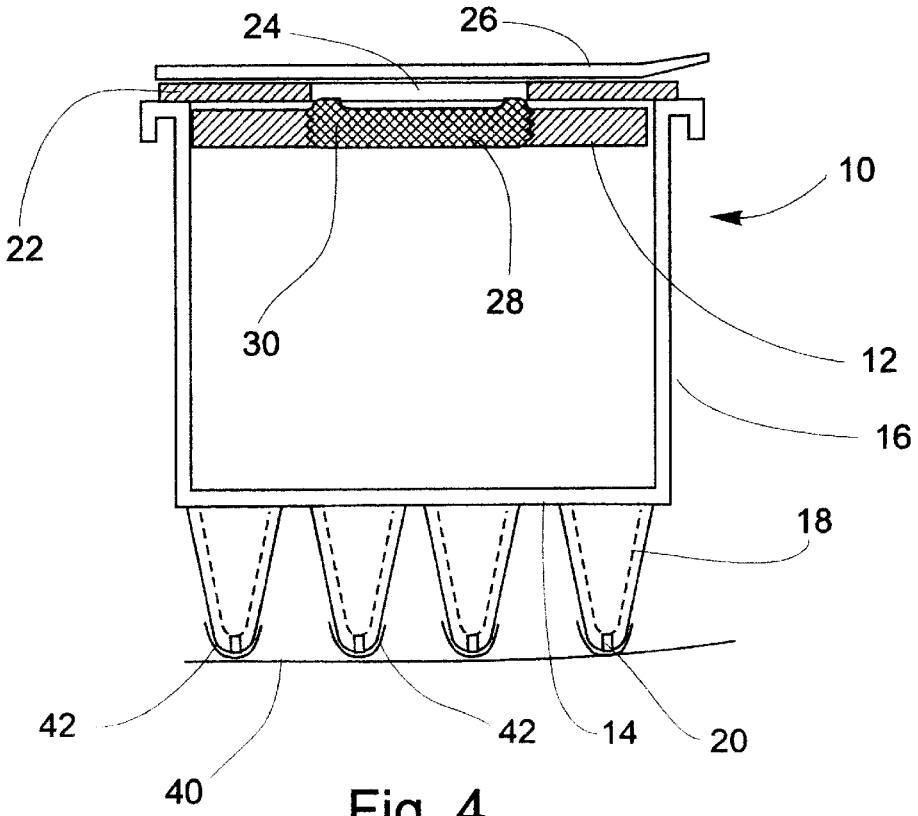
FIG. 4 is a schematic side cross-sectional view of a third implementation of a cartridge for use in a hair dye dispenser, constructed and operative according to the teachings of the present invention.
Figure 5:
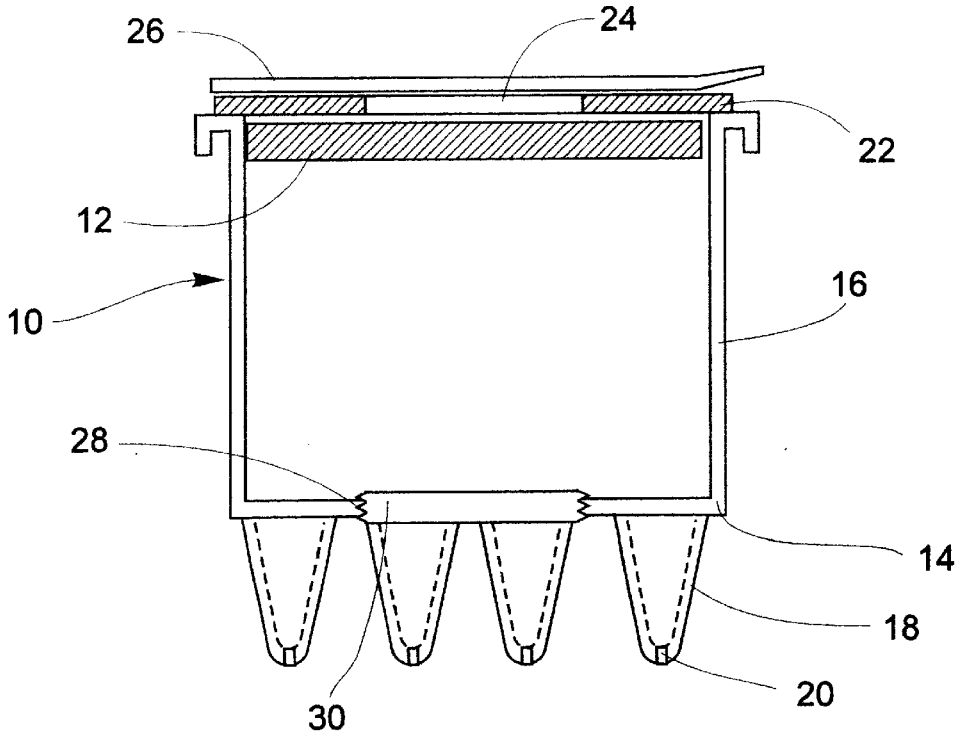
FIG. 5 is a schematic side cross-sectional view of a fourth implementation of a cartridge for use in a hair dye dispenser, constructed and operative according to the teachings of the present invention.

Referring now specifically to FIGS. 4 and 5, it will be apparent that the retaining effects of pressure-fitting described above do not offer safeguards against direct finger pressure or other forces acting directly on piston 12. Accordingly, certain preferred implementations of the present invention offer additional features to help prevent inadvertent displacement of piston 12 from its initial position prior to use. Specifically, FIGS. 4 and 5 illustrated cartridges generally similar to those of FIGS. 2 and 3, respectively, additionally featuring a shield element 22 connected to side wall 16 so as to be deployed in overlying relation to at least part of piston 12. Since shield element 22 is supported directly by wall 16, any pressure or impact exerted upon the shield is redirected away from piston 12, thereby avoiding accidental misalignment of the piston. Shield element 22 may be implemented either as a continuous surface, in the form of an open mesh or in any other form which is effective for preventing transfer of pressure from a finger or like object to at least part of piston 12. Furthermore, a number of separate shield elements 22 may be attached at positions spaced around side wall 16 so that each covers a different region of piston 12.

Optionally, the overall shape of shield element 22 may approximate to a disk, overlying the entirety to piston 12. In this case, the shield element is removed prior to use. More preferably, shield element 22 is substantially annular, extending around substantially the entirety of side wall 16 and having a central opening 24 through which pressure may be applied to the piston. In this case, shield element 22 preferably remains in place during use of the cartridge within a dispenser. Central opening 24 is optionally covered prior to filling of the cartridge by a removable secondary covering such as a layer of foil 26 overlying shield element 22. This secondary covering further protects piston 12 prior to use and, in the case that a dye component is supplied stored within the cartridge as will be discussed below, may also provide a secondary hermetic seal.

In principle, depending upon the treatment to be performed and the fluid to be dispensed from the cartridge, it may be possible to provide the cartridge to the user with the required components already inside. In the case of permanent hair dyes, this would require provisions for separate storage of two or more components within the container and subsequent mixing prior to use. While such provisions may be implemented using frangible dividers between separate compartments, they are considered unnecessarily complex and expensive for the present invention. Instead, preferred embodiments of the present invention provide a sealable filling aperture 28 for introducing one or more component into the cartridge.

Clearly, sealable filling aperture 28 could be implemented in many locations and configurations in the cartridge. In the preferred case of a cylindrical or otherwise curved side wall 16, the side wall is preferably not used for the filling aperture due to the difficulty of ensuring a proper seal around the piston. A circumferential threaded connection subdividing wall 16 may be used. Other implementations such as with a straight-sided cartridge (square, rectangular, polygonal or other) may facilitate inclusion of aperture 28 with an appropriate sealing element in a side wall. Preferably, however, filling aperture 28 is implemented either within piston 12 or as part or all of base 14.

Figure 2:
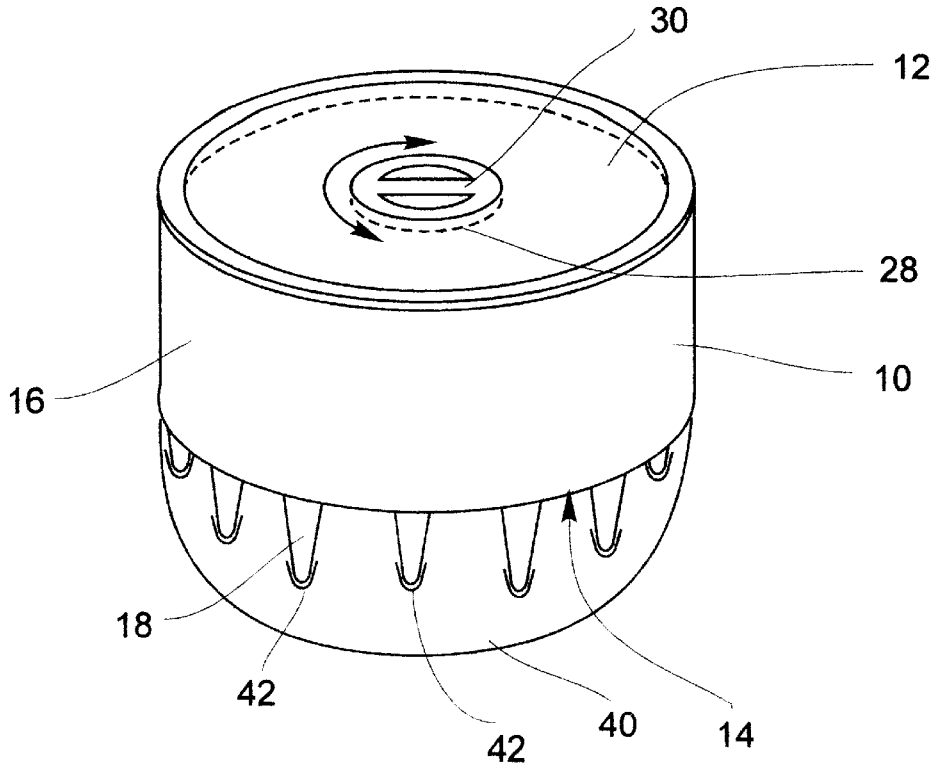
FIG. 2 is a schematic isometric view of a first implementation of a cartridge for use in a hair dye dispenser, constructed and operative according to the teachings of the present invention.

Thus, turning to FIGS. 2 and 4, there are shown two implementations of the cartridge of the present invention in which piston 12 features a filling aperture 28 which is provided with a complementary removable sealing element 30. The position and size of aperture 28 in piston 12 is generally not critical. However, in the case of FIG. 4 which employs shield element 22, aperture 28 is sized and positioned so as to be accessible through an opening, in this case, central opening 24. Preferably, the size of the aperture is such that an additional region of piston 12 also remains accessible through central opening 24 as a margin around aperture 28, allowing the actuator of a dispenser to exert pressure directly upon the main part of piston 12. Aperture 28 and sealing element 30 preferably feature complementary threading to facilitate removal and resealing of sealing element 30 by the user.

FIGS. 3 and 5 show alternative implementations in which base 14 features a filling aperture 28 with complementary removable sealing element 30 to allow introduction of at least one dye component into the cartridge. The position and configuration of aperture 28 must be chosen so as not to conflict with, or be obstructed by, the positioning of tines 18 and dispensing apertures 20. This may be achieved by rendering substantially the entire base 14 removable such that all of tines 18 and dispensing apertures 20 may be considered part of sealing element 30, by subdividing tines 18 and/or dispensing apertures 20 between sealing element 30 and the remainder of base 14, or by forming aperture 28 and sealing element 30 in a region of base 14 free from tines 18 and dispensing apertures 20.

In this context, it will be useful to describe a preferred configuration for tines 18 and dispensing apertures 20 illustrated in FIGS. 2–5. Preferably, at least one, and typically all, of dispensing apertures 20 are implemented as channels along the length of projecting tines 18. This ensures effective delivery of the hair dye down to the root portion of the hair where it is typically most needed. A further particularly preferred feature is that dispensing apertures 20 are distributed substantially around the periphery of base 14, and most preferably, substantially evenly spaced around a substantially circular line. With at least 6, and preferably between about 8 and about 20, tines formed with dispensing apertures, this renders the distribution of dye roughly uniform over the area swept through by the dispenser independent of the direction in which the dispenser is moved. As a result, the user does not need to be particular about the angle at which the dispenser is held relative to the direction of brushing in the dye.

This preferred destruction of tines 18 and dispensing apertures 20 over base 14 typically leaves a central region of base 14 free and readily accessible, making this the preferred position for aperture 28 as illustrated in FIGS. 3 and 5. Here too, aperture 28 and sealing element 30 preferably feature complementary threading to facilitate removal and resealing of sealing element 30 by the user.

Figure 6:
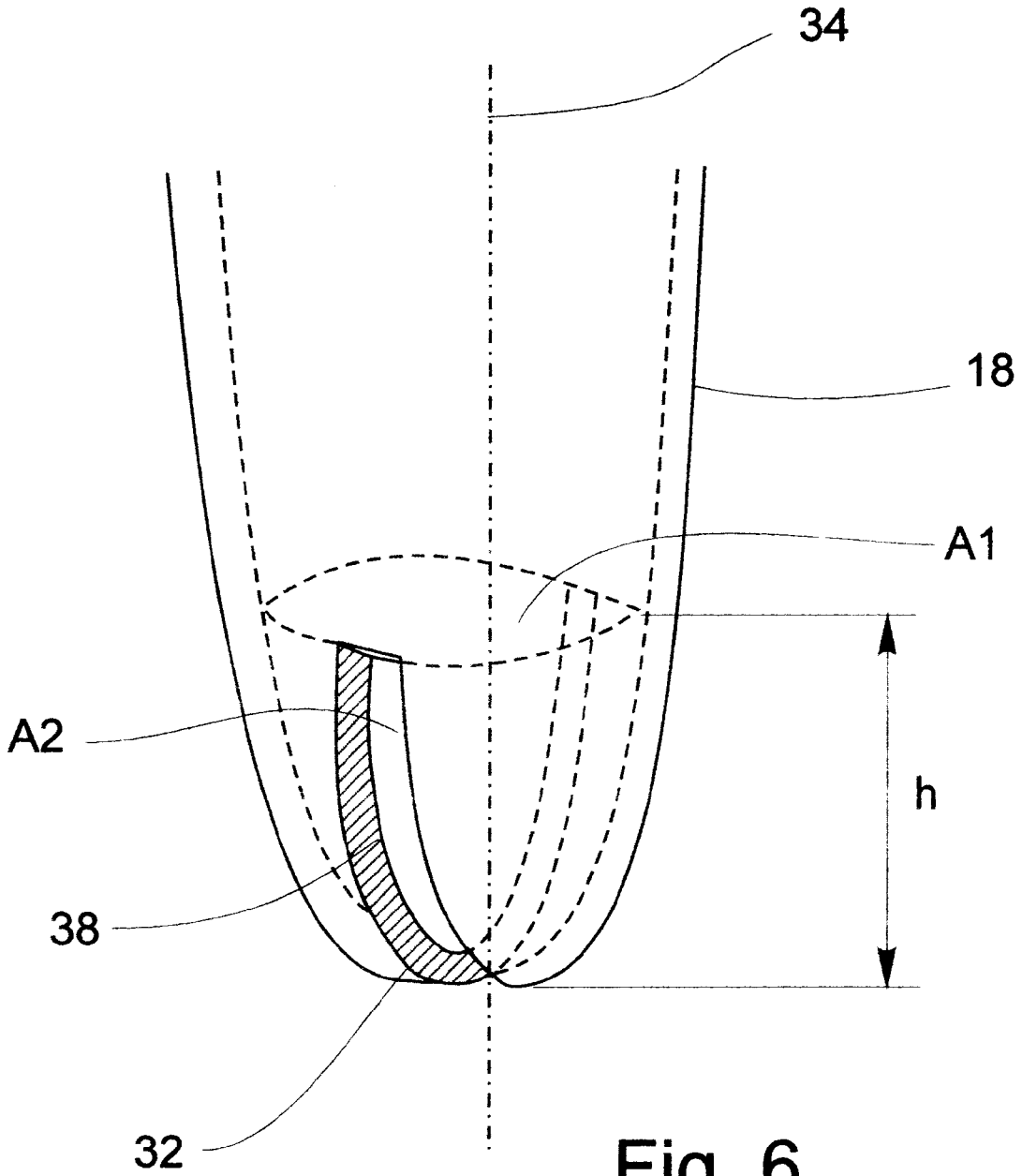
FIG. 6 is an enlarged isometric view of the end portion of a preferred form of a tine formed with a dispensing aperture for use in the cartridges of the present invention.

Turning now to FIG. 6, there is illustrated a particularly preferred form of dispensing aperture 20 for use with the present invention. As mentioned above, some or all of dispensing apertures 20 are preferably implemented as dispensing channels along projecting tines 18. However, it is thought that a simple axial channel terminating at the tip of the tine produces a non-optimal distribution of dye in the hair and may even suffer from occlusion due to close proximity with the scalp during use. The aspect of the present invention illustrated in FIG. 6 offers a solution to this problem. It is important to note that this aspect of the present invention is not limited to the context of the remaining features of the cartridges of the present invention and could in fact be used to advantage in an otherwise conventional dispensing container.

Turning now explicitly to FIG. 6, there is shown a tip 32 of a tine 18, which is shown to have an axis 34 parallel to its length. In this implementation, the dispensing channel includes a central channel 36 extending within tine 18 parallel to axis 34 and a dispensing slot 38 formed through tine 18 adjacent to its tip 32 so as to intersect with central channel 36. It is a particular feature of this aspect of the present invention that an effective cross-sectional area A1 of central channel 36 proximal to slot 38 is at least about equal to the total dispensing area A2 of slot 38. This ensures that the local flow capacity of central channel 36 is at least equal to that of dispensing slot 38 so that the dye is released substantially uniformly along the length of the slot.

It will be apparent that the "effective cross-sectional area" A1 of central channel 36 for the purpose of this definition is the cross-sectional area taken perpendicular to the flow direction where the flow first intersects dispensing slot 38. Typically, this corresponds to the maximum area of the central channel measured perpendicular to axis 34 at a position adjacent to the slot. The "dispensing area" A2 for a regular rectangular slot 38 is simply the product of the length of the slot and its breadth as measured over the surface of tine 18.

The advantageous effects of dispensing slot 38 are most pronounced when the slot extends from tip 32 into tine 18 to a "height" h of at least about 2 mm, and preferably between about 3 and about 8 mm, as measured parallel to axis 34. This gives a flow characteristic that has been found to be highly effective for rapidly achieving a uniform distribution of fluid through the hair of the user. Values of h above about 1 cm are usually not required. The breadth of slot 38, which is generally independent of the required height h, is preferably chosen according to the thickness/viscosity of the fluid to be dispensed.

To complete the structural description of the cartridges of the present invention, it should be noted that dispensing container 10 need not assume a symmetrical cylindrical form. Examples of other possible shapes of base 14 include, but are not limited to, elliptical, square, rectangular and other regular or irregular polygonal shapes. Furthermore, although side wall(s) 16 are typically perpendicular to base 14, this is not a necessary condition. Similarly, for different applications and types of hair, the design, spacing and number of dispensing apertures may be varied considerably. By way of example, one alternative aperture design employs a single elongated slit along a major part of base 14 to dispense the dye.

Additionally, the dimensions of dispensing container 10 are preferably chosen such that the dye can be dispensed over a relatively large area simultaneously, while minimizing the height dimension so that the dispenser can be kept as compact as possible. To this end, a major dimension of the base designated "length" is preferably at least about twice the "height" defined as the dimension of side wall 16 measured perpendicular to the length. In a preferred implementation in which base 14 is round and side wall 16 is correspondingly a single substantially cylindrical wall, the "length" will correspond to the internal diameter of wall 16.

Turning now to the use of the cartridges of the present invention and certain accessories for facilitating that use, it will be noted that there are a number of options as to the sequence of mixing of dye components and filling of the cartridge. Optionally, one dye component may be supplied already within the cartridge. In this case, sealing element 30 is removed and the remaining one or more components are inserted into the cartridge through filling aperture 28. Sealing element 30 is then replaced and the cartridge shaken to mix the components until the cartridge is ready for use. Parenthetically, it is noted that the use of relatively transparent materials such as polypropylene for the cartridge is advantageous in this regard since it allows the user to see whether the dye has been sufficiently mixed for use.

Referring again briefly to FIG. 2, there is shown a lower sealing layer 40 which includes a number of shaped seals 42 for sealing dispensing apertures 20 prior to use. Some degree to sealing is required in most applications to prevent seepage occurring between filling of the cartridge and the start of operation. A higher degree of sealing is required when one of the components is stored within the cartridge for an extended period prior to use. The required sealing can readily be achieved using shaped seals 42 in the form of foil coverings, small plug elements or by any other conventional sealing means or combination thereof. The implementation of sealing layer 40 in the form of a plate of diameter slightly greater than the widest spacing of dispensing apertures 20 serves an additional purpose, catching any drips of dye which may be released during priming of the dispenser before the device is positioned against the head of the user. In the case that filling aperture 28 is located within base 14 as shown in FIGS. 4 and 6, an annular implementation of sealing layer 40 may provide an equivalent function.

An alternative filling option is that all components are provided separately from the cartridge, to be mixed either prior to or after insertion into the cartridge. In this case, the components may be supplied in separate conventional packaging for manual filling of the cartridge. It is noted, however, that the conventional packaging for dye pigments, namely, squeezable tubes, are far from ideal due to the considerable dead-volume wastage. Furthermore, the user is relied upon to provide the correct proportions of each of the components in turn. To avoid these problems, the present invention preferably provides a two-component storage and filling device for storage and controlled release of correct proportions to two dye components in a single operation.

Figure 7:
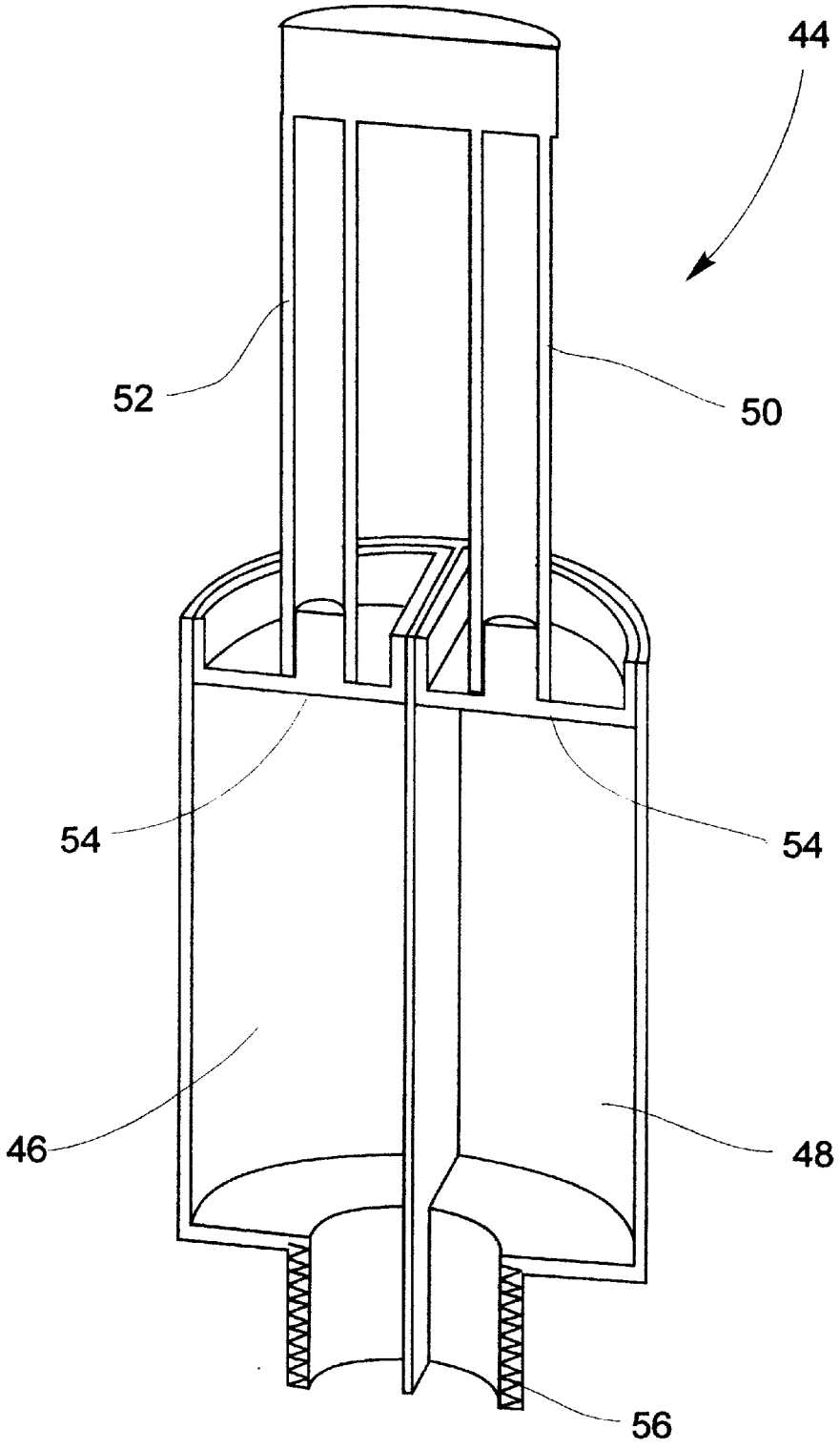
FIG. 7 is a partially cut-away isometric view of a two-component storage and filling device for use with the cartridges of the present invention.

Accordingly, FIG. 7 shows a two-component storage and filling device 44, constructed and operative according to the teachings of the present invention, formed with a first compartment 46 for storing a first hair dye component, and a second compartment 48 for storing a second hair dye component. A dispensing mechanism, shown here in the form of a twin dispensing piston 50, allows simultaneous dispensing of the first and second hair dye components through aperture 28 into the cartridge.

In the specific implementation shown here, two-component storage and filling device 44 takes the form of a syringe compartmentalized along its length. This allows the relative volumes of the two components to be set by appropriate choice of the relative cross-sectional area of the two compartments. For compact storage prior to use, twin dispensing piston 50 is preferably formed from a separate plunger 52 with two parallel rods which are configured to engage otherwise independent piston elements 54. Since this structure ensures that the two piston elements always advance equally, the predefined proportions between the components are preserved independent of the quantities dispensed. The syringe-type structure also has a very small dead-space, therefore dispensing a much higher proportion of the components than can be obtained from conventional squeezable tubes.

Figure 8:
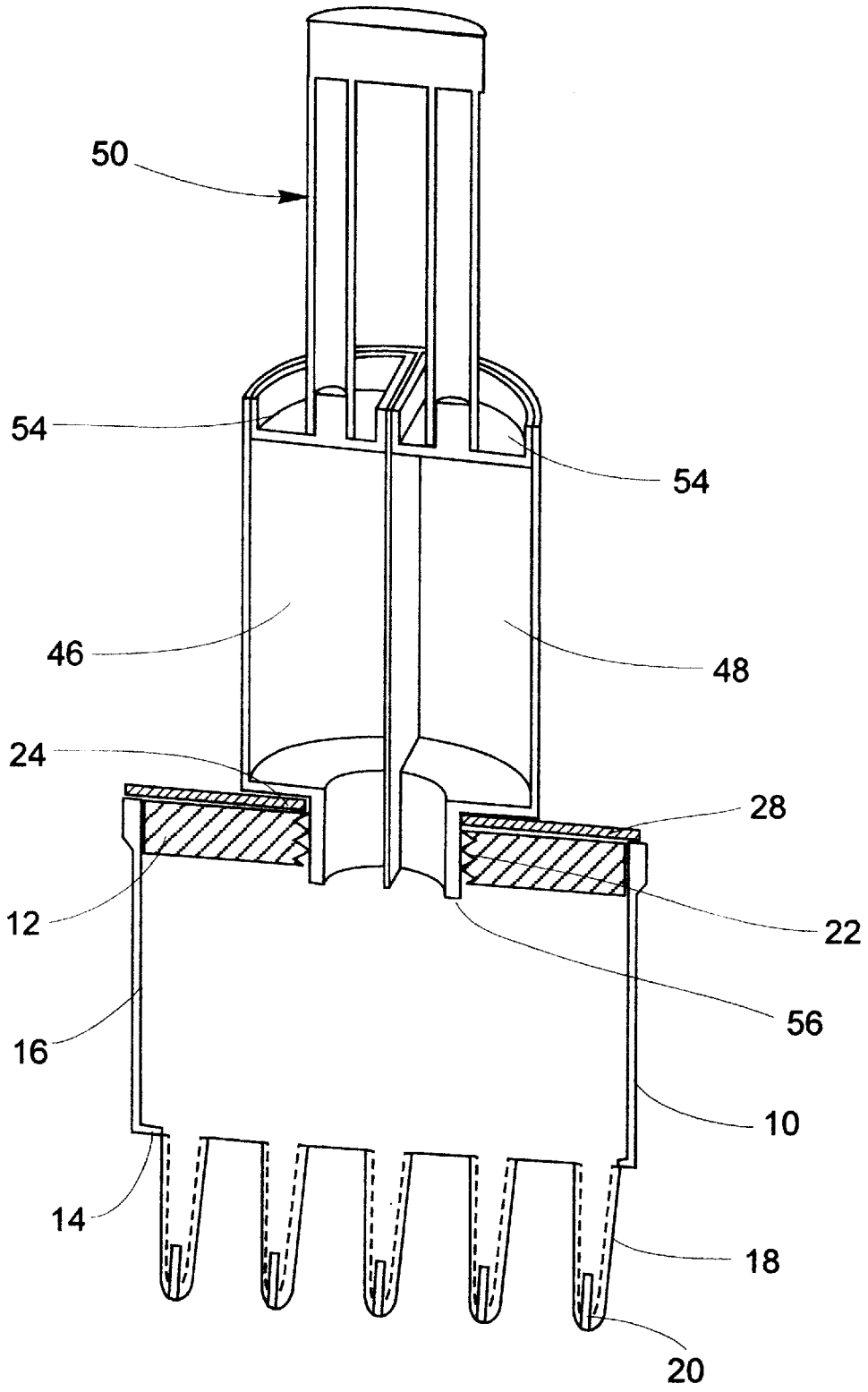
FIG. 8 is a partially cut-away isometric view of the two-component storage and filling device of FIG. 7 being used to fill the cartridge of FIG. 4.

FIG. 8 shows two-component storage and filling device 44 in use for filling the cartridge of FIG. 4 in the case of mixing within the cartridge. Plunger 52 is first attached to piston elements 54 and a sealing cap and/or foil seal is removed from the combined outlet nozzle 56 of compartments 46 and 48. Nozzle 56 is then inserted through filling aperture 28 and piston 50 is pushed forward to insert the required quantities of dye components. In this implementation, device 44 is configured to minimize the likelihood of inadvertently displacing piston 12 from its initial position. Thus, nozzle 56 is preferably smooth sided with a diameter somewhat smaller than that of filling aperture 28 while the outer dimensions of the device are such that it rests primarily on shield element 22. For use with the implementations of FIGS. 3 and 5 where aperture 28 is formed in base 14, not all of these precautions are required.

Figure 9:
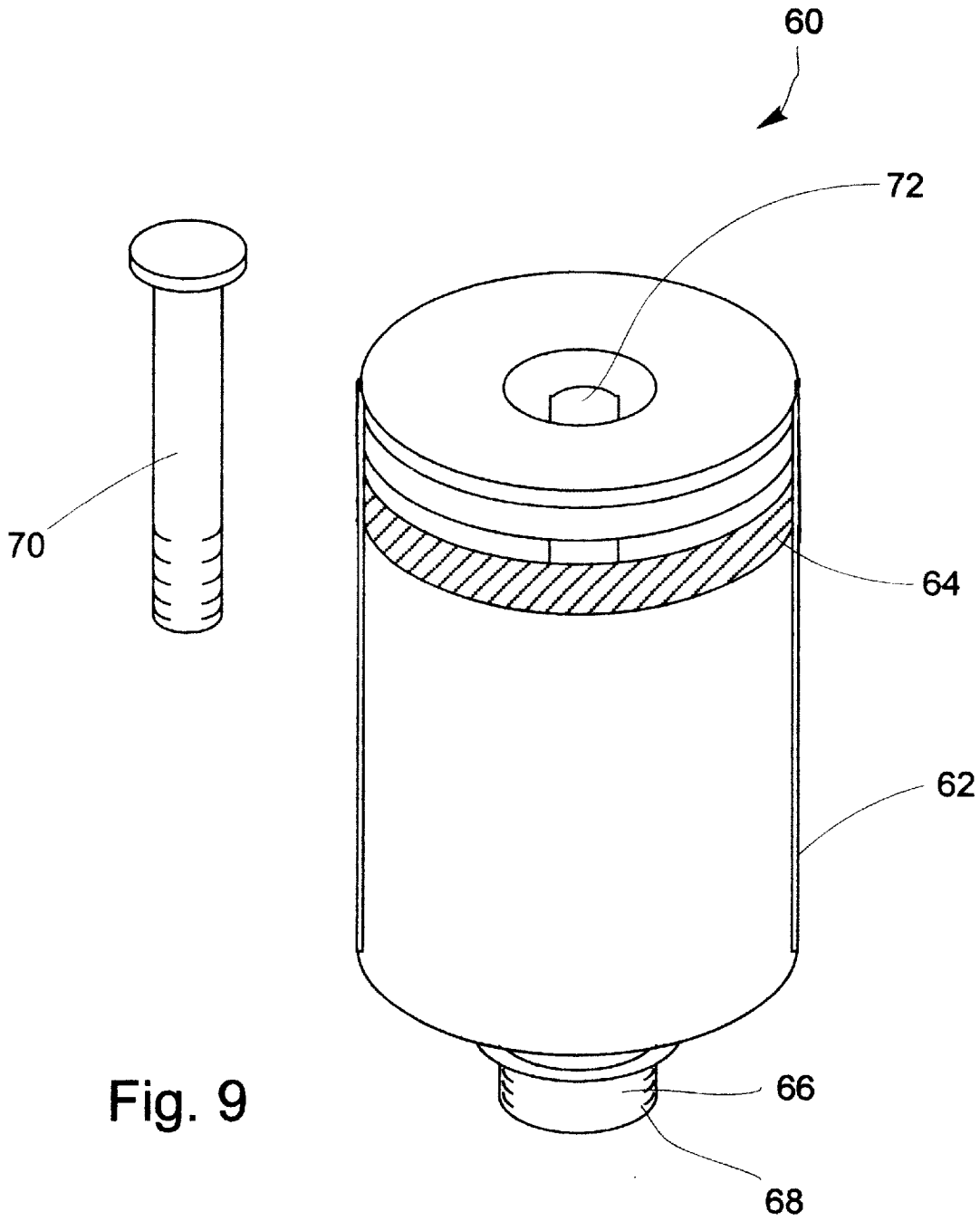
FIG. 9 is a partially cut-away schematic isometric view of a mixing container for use with the cartridges of the present invention.
Figure 10:
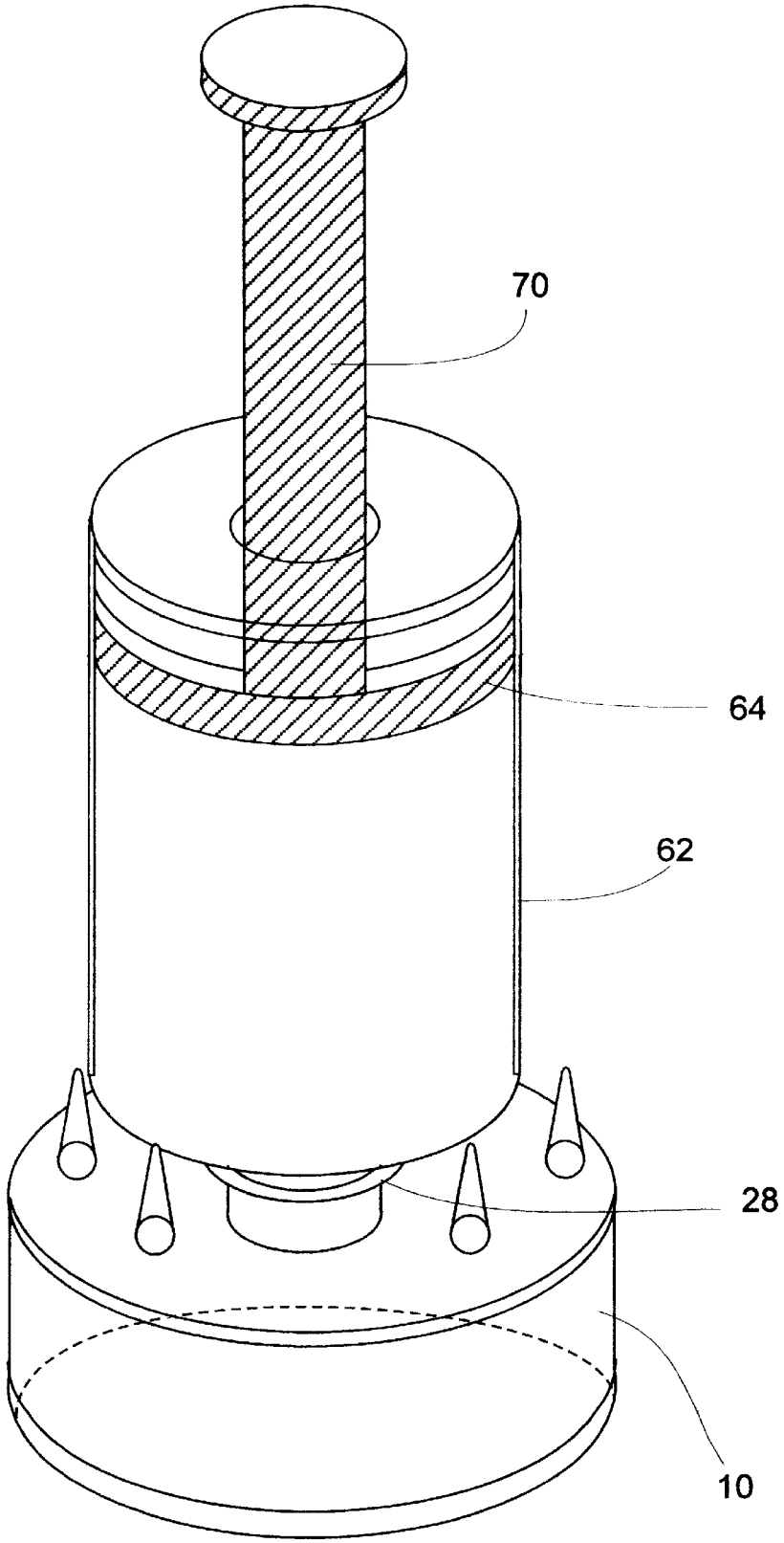
FIG. 10 is a partially cut-away schematic isometric view of the mixing container of FIG. 9 being used to fill the cartridge of FIG. 5.

Turning finally to FIGS. 9 and 10, it is noted that mixing of dye components may in certain cases be achieved more effectively where the mixing volume is significantly greater than the total volume of the components. For this reason, it may be preferable in certain implementations of the present invention to mix the dye compositions before filling the cartridge. FIGS. 9 and 10 illustrate a mixing container 60, constructed and operative according to the teachings of the present invention, which is particularly advantageous for this purpose.

Mixing container 60 is preferably formed with a cylindrical body 62 which defines a mixing chamber terminating at one end in a piston element 64 and at the other in a nozzle 66 sealed by a resealable cap 68. Here too, for compactness of storage, a removable piston rod 70 is configured to engage piston element 64 through an opening 72 at the end of body 62.

Use of mixing container 60 is as follows. Resealable cap 68 is removed and the container placed with open nozzle 66 facing upwards (this position being stable before piston rod 70 is attached). The dye components are then introduced into the mixing chamber, either by use of two-component storage and filling device 44 described above or from conventional storage containers. Resealable cap 68 is replaced and the mixing container 60 shaken until the required degree of mixing has been achieved. Here too, body 62 is advantageously implemented using somewhat transparent materials to make it easy to check the uniformity of mixing.

After mixing, container 60 is again placed with nozzle 66 facing upwards and cap 68 is removed. Sealing element 30 is removed from the cartridge and the cartridge is positioned over container 60 with open nozzle 66 inserted through open filling aperture 28. The structure is then inverted and piston rod 70 is attached to piston element 64 through opening 72. At this stage, piston rod 70 can be advanced into container 60 until the required quantity of mixed dye is inserted into the cartridge. The cartridge is then sealed with sealing element 30 to render the cartridge ready for use.

It will be appreciated that the above descriptions are intended only to serve as examples, and that many other embodiments are possible within the spirit and the scope of the present invention.

What is claimed is:

1. A cartridge for use in a hair dye dispenser, the cartridge comprising:

(a) a dispensing container for containing and dispensing the hair dye, said dispensing container having a base and at least one side wall sealingly interconnected with said base so as to define an internal volume of said dispensing container, said base having a lower surface which is formed with a plurality of projecting tines, at least one dispensing aperture being formed through said base; and (b) a piston configured to fit closely in sliding abutment with said at least one side wall so as to be sealingly slidable towards said base, wherein said at least one dispensing aperture is implemented as a dispensing channel along at least one of said projecting tines, said at least one of said projecting tines having an axis and a tip, said dispensing channel including:

(i) a central channel extending within said tine parallel to said axis; and (ii) a dispensing slot formed through said tine adjacent to said tip so as to intersect with said central channel, said dispensing slot having a dispensing area, wherein said channel has a given effective cross-sectional area adjacent to said dispensing slot, said effective cross-sectional area being at least about equal to said dispensing area.

2. The cartridge of claim 1, further comprising a shield element connected to said at least one side wall so as to be deployed in overlying relation to at least part of said piston.

3. The cartridge of claim 2, wherein said shield element is substantially annular, having a central opening to allow external application of pressure on said piston and extending around substantially the entirety of said at least one side wall.

4. The cartridge of claim 1, wherein said piston features an aperture provided with a complementary removable sealing element to allow introduction of at least one dye component into the cartridge.

5. The cartridge of claim 1, wherein said base features an aperture provided with a complementary removable sealing element to allow introduction of at least one dye component into the cartridge.

6. The cartridge of claim 1, wherein said dispensing slot extends from said tip into said tine at least about 2 mm as measured parallel to said axis.

7. The cartridge of claim 1, wherein said dispensing slot extends from said tip into said tine by between about 3 and about 8 mm as measured parallel to said axis.

8. A cartridge for use in a hair dye dispenser, the cartridge comprising:

(a) a dispensing container for containing and dispensing the hair dye, said dispensing container having a base and at least one side wall sealingly interconnected with said base so as to define an internal volume of said dispensing container, said base having a lower surface which is formed with a plurality of projecting tines, at least one dispensing aperture being formed through said base; and (b) a piston configured to fit closely in sliding abutment with said at least one side wall so as to be sealingly slidable towards said base, wherein said piston features an aperture provided with a complementary removable sealing element to allow introduction of at least one dye component into the cartridge.

9. The cartridge of claim 8, further comprising a substantially annular shield element connected to, and extending around substantially the entirety of, said at least one side wall, said shield element having a central opening through which said aperture is accessible.

10. A hair dye cartridge system for use in preparation and dispensing of hair dye in a hair dye dispenser, the hair dye cartridge system comprising:

(a) the cartridge of claim 8; and (b) a two-compartment storage and filling device having:

(i) a first compartment for storing a first hair dye component, (ii) a second compartment for storing a second hair dye component, and (iii) a dispensing mechanism for simultaneously dispensing said first and second hair dye components through said aperture into said cartridge.

11. A hair dye cartridge system for use in preparation and dispensing of hair dye in a hair dye dispenser, the hair dye cartridge system comprising:

(a) the cartridge of claim 8; and (b) a mixing container having:

(i) a hollow body defining a parallel-sided mixing chamber having a first end and a second end, (ii) a piston element displaceable along said hollow body from said first end towards said second end, (iii) a removable piston rod for engaging with said piston element, and (iv) a resealable opening connecting with said mixing chamber at said second end.

12. A cartridge for use in a hair dye dispenser, the cartridge comprising:

(a) a dispensing container for containing and dispensing the hair dye, said dispensing container having a base and at least one side wall sealingly interconnected with said base so as to define an internal volume of said dispensing container, said base having a lower surface which is formed with a plurality of projecting tines, at least one dispensing aperture being formed through said base; and (b) a piston configured to fit closely in sliding abutment with said at least one side wall so as to be sealingly slidable towards said base, wherein said base features an aperture provided with a complementary removable sealing element to allow introduction of at least one dye component into the cartridge.

13. A hair dye cartridge system for use in preparation and dispensing of hair dye in a hair dye dispenser, the hair dye cartridge system comprising:

(a) the cartridge of claim 12; and (b) a two-component storage and filling device having:

(i) a first compartment for storing a first hair dye component, (ii) a second compartment for storing a second hair dye component, and (iii) a dispensing mechanism for simultaneously dispensing said first and second hair dye components through said aperture into said cartridge.

14. A hair dye cartridge system for use in preparation and dispensing of hair dye in a hair dye dispenser, the hair dye cartridge system comprising:

(a) the cartridge of claim 12; and (b) a mixing container having:

(i) a hollow body defining a parallel-sided mixing chamber having a first end and a second end, (ii) a piston element displaceable along said hollow body from said first end towards said second end, (iii) a removable piston rod for engaging with said piston element, and (iv) a resealable opening connecting with said mixing chamber at said second end.

* * * * *